US008272428B2

(12) United States Patent
Fujii et al.

(10) Patent No.: US 8,272,428 B2
(45) Date of Patent: Sep. 25, 2012

(54) COOLING APPARATUS USING BRINE

(75) Inventors: Takahisa Fujii, Kariya (JP); Yuji Ito, Okazaki (JP); Yasuhiko Niimi, Handa (JP)

(73) Assignee: Denso Corporation, Kariya (JP)

( * ) Notice: Subject to any disclaimer, the term of this patent is extended or adjusted under 35 U.S.C. 154(b) by 1120 days.

(21) Appl. No.: 12/217,036

(22) Filed: Jul. 1, 2008

(65) Prior Publication Data

US 2009/0008077 A1 Jan. 8, 2009

(30) Foreign Application Priority Data

Jul. 4, 2007 (JP) ..... 2007-176546
May 15, 2008 (JP) ..... 2008-128776

(51) Int. Cl.
*F28D 15/00* (2006.01)
*F28F 27/02* (2006.01)

(52) U.S. Cl. ..... 165/104.31; 165/104.28; 165/301; 165/100

(58) Field of Classification Search ..... 165/279, 165/281, 286, 287, 71, 96, 100, 104.28, 104.31, 165/144, 120
See application file for complete search history.

(56) References Cited

U.S. PATENT DOCUMENTS 3,965,971 A * 6/1976 Roggenkamp ..... 165/299
3,977,210 A * 8/1976 Bruguier ..... 62/324.6
5,048,599 A * 9/1991 Tustaniwskyj et al. .. 165/104.32
5,293,754 A * 3/1994 Mizuno ..... 62/185
7,527,085 B2 5/2009 Iijima et al.
2005/0034466 A1 2/2005 Sato et al.
2006/0102326 A1* 5/2006 Kobayashi ..... 165/104.33
2007/0227702 A1* 10/2007 Bhatti et al. ..... 165/104.21

FOREIGN PATENT DOCUMENTS

JP 6-501819 2/1994
JP 2002-353668 12/2002
JP 2002-368471 12/2002
JP 2005-064186 3/2005
JP 2005-223024 8/2005

OTHER PUBLICATIONS

Office action dated Jul. 7, 2009 in Japanese Application No. 2008-128776.

* cited by examiner

*Primary Examiner* — Frantz Jules
*Assistant Examiner* — Alexandro Acevedo Torres
(74) *Attorney, Agent, or Firm* — Harness, Dickey & Pierce, PLC

(57) ABSTRACT

A cooling apparatus includes a brine circuit through which brine flows, a pump disposed on the brine circuit, and a heat exchanger unit including a heat absorbing member and a heat radiating member. The heat absorbing member is in communication with the brine circuit. The heat absorbing member is capable of conducting heat generated from a cooling object to the brine for cooling the cooling object. The heat radiating member is in communication with the brine circuit and capable of receiving the heat from the brine. The brine circuit is configured such that the brine passes through the heat exchanger unit at a pressure equal to or lower than an atmospheric pressure.

1 Claim, 14 Drawing Sheets

COOLING APPARATUS USING BRINE

CROSS REFERENCE TO RELATED APPLICATION

This application is based on Japanese Patent Applications No. 2007-176546 filed on Jul. 4, 2007 and No. 2008-128776 filed on May 15, 2008, the disclosure of which are incorporated herein by reference.

FIELD OF THE INVENTION

The present invention relates to a cooling apparatus using brine.

BACKGROUND OF THE INVENTION

For example, Japanese Unexamined Patent Application Publication No. 2005-64186 (US2005/0034466) describes a cooling system including a heat absorbing member for performing heat exchange between a cooling object and brine, a heat radiating member for performing heat exchange between the brine which has received heat from the heat absorbing member and air, and a brine circuit through which the brine flows, and a pump for pressurizing the brine. The brine is circulated through the heat absorbing member and the heat radiating member by the pump. That is, discharge pressure of the pump is exerted to the heat absorbing member and the heat radiating member.

Japanese Unexamined Patent Application Publication No. 2002-353668 describes a cooling apparatus having a heat conductive plate, a fin as a heat radiating member disposed on one surface of the heat conductive plate and a passage-forming member as a heat absorbing member closely disposed on the opposite surface of the heat conductive plate. The passage-forming member has a depressed portion for forming a cooling medium passage (brine passage) and bridge portions extending from a bottom surface of the depressed portion toward the heat conductive plate. The bridge portions have the height same as the depth of the depressed portion such that the bridge portions contact the heat conductive plate. The bridge portions are surrounded by the cooling medium passage.

An electronic device as a cooling object is fixed to a surface of the passage-forming member on a side opposite to the heat conductive plate through a heat spreading plate. Heat generated by the electronic device is transferred to the fin through the bridge portions of the passage-forming member and the heat conductive plate, and is radiated from the fin.

In the above cooling apparatuses, the brine circuit is a closed circuit, and the brine is circulated by means of the pump. The discharge pressure of the pump is exerted to the heat absorbing member and the heat radiating member. That is, an internal pressure of the brine circuit is higher than an atmospheric pressure. Therefore, if a brine passage in the heat absorbing member or the heat radiating member is broken, the brine will leak from the brine passage, resulting in defects of the electronic devices, such as short-circuit.

SUMMARY OF THE INVENTION

The present invention is made in view of the foregoing matter, and it is an object of the present invention to provide a cooling apparatus using brine, which is capable of reducing leakage of the brine from a brine circuit.

According to an aspect of the present invention, a cooling apparatus includes a brine circuit through which brine flows, a pump, and a heat exchanger unit including a heat absorbing member and a heat radiating member. The heat absorbing member is disposed to be in communication with the brine circuit and capable of conducting heat generated from a cooling object to the brine of the brine circuit for cooling the cooling object. The heat radiating member is disposed to be in communication with the brine circuit and capable of receiving the heat from the brine. The pump is disposed on the brine circuit. The brine circuit is configured such that the brine passes through the heat exchanger unit at a pressure equal to or lower than an atmospheric pressure.

Since the pressure at the heat exchanger unit is maintained equal to or lower than the atmospheric pressure, even if a brine passage of the heat exchanger unit is broken, it is less likely that the brine will leak from the brine circuit.

For example, a pressure-reducing device is provided on the brine circuit downstream of the pump and upstream of the heat exchanger unit with respect to a flow of the brine in the brine circuit. The pressure-reducing device is configured to reduce pressure downstream of the pump such that the brine passes through the heat exchanger unit at the pressure equal to or lower than the atmospheric pressure. As another example, a pressure-equalizing device is provided on the brine circuit downstream of the pump and upstream of the heat absorbing member with respect to a flow of the brine in the brine circuit. The pressure-equalizing device is capable of controlling pressure downstream of the pump equal to the atmospheric pressure.

According to a second aspect of the present invention, a cooling apparatus includes a brine circuit through which brine flows, a heat exchanger unit including a heat absorbing member and a heat radiating member, a pump, a pressure-equalizing device, and a switching device. The heat absorbing member is disposed to be in communication with the brine circuit and capable of conducting heat generated from a cooling object to the brine for cooling the cooling object. The heat radiating member is disposed to be in communication with the brine circuit and capable of receiving the heat from the brine. The pump is disposed on the brine circuit. The pressure-equalizing device is disposed on the brine circuit and capable of controlling pressure equal to an atmospheric pressure. The heat exchanger unit, the pump, the switching device and the pressure-equalizing device are arranged in order. The switching device is capable of switching between a positive pressure mode and a negative pressure mode by changing a flow direction of the brine. In the positive pressure mode, the switching device allows a suction side of the pump to communicate with the pressure-equalizing device and allows a discharge side of the pump to communicate with the heat exchanger unit. That is, the switching device allow the brine to flow from the pressure-equalizing device to the pump. In the negative pressure mode, the switching device allows the suction side of the pump to communicate with the heat exchanger unit and allows the discharge side of the pump to communicate with the pressure control device. That is, the switching device allows the brine to flow from the pump to the pressure-equalizing device.

Accordingly, when the brine is to be introduced in the brine circuit, the switching device is switched to a positive pressure mode position so that the brine flows from the pressure-equalizing device to the pump. Therefore, the brine is easily introduced in the brine circuit without requiring vacuum drawing. In the negative pressure mode, the brine passes through the heat exchanger unit at a pressure equal to or lower than the atmospheric pressure. Therefore, even if a brine passage of the heat exchanger unit is broken, it is less likely that the brine will leak from the brine circuit.

BRIEF DESCRIPTION OF THE DRAWINGS

Other objects, features and advantages of the present invention will become more apparent from the following detailed description made with reference to the accompanying drawings, in which like components are designated by like reference characters and in which.

DETAILED DESCRIPTION OF EXEMPLARY EMBODIMENTS

Figure 1:
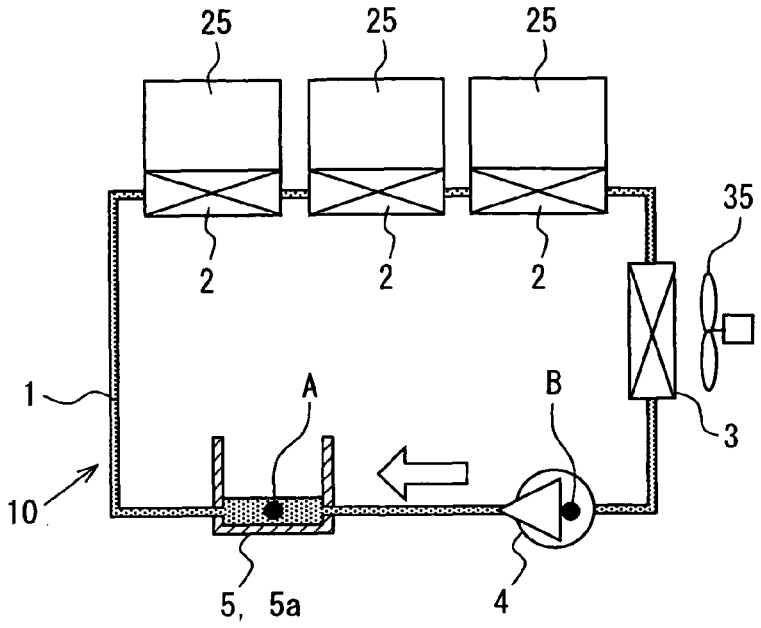
FIG. 1 is a schematic diagram of a cooling apparatus according to a first embodiment of the present invention.

Exemplary embodiments of the present invention will now be described with reference to the accompanying drawings. In the embodiments, like components are designated by like reference characters, and a description thereof will not be repeated.

First Embodiment

Figure 2:
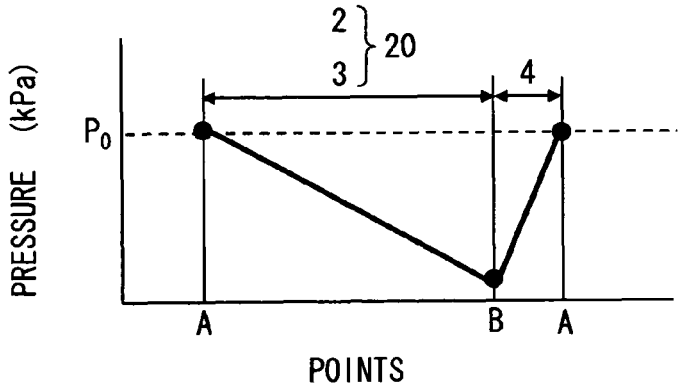
FIG. 2 is a graph showing a change in pressure of a brine circuit of the cooling apparatus shown in FIG. 1.
Figure 3:
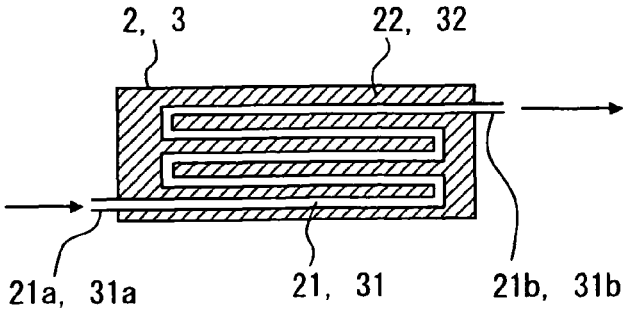
FIG. 3 is a schematic cross-sectional view of a heat absorbing member and a heat radiating member of the cooling apparatus according to the first embodiment.

Referring to FIGS. 1 to 3, in the present embodiment, a cooling apparatus 10 is exemplarily employed to cool electronic devices 25, such as thyristors and power transistors, mounted to a vehicle.

The cooling apparatus 10 cools heat generated by the electronic devices 25 using brine as refrigerant. As shown in FIG. 1. the cooling apparatus 10 generally includes heat absorbing members 2, a heat radiating member 3, a pump 4, and a pressure-reducing device 5 as an example of a pressure control device. The heat absorbing members 2, the heat radiating member 3, the pump 4 and the pressure-reducing device 5 are connected in order through a looped brine circuit 1. In the present embodiment, the cooling apparatus 10 has three heat absorbing members 2.

The brine circuit 1 is filled with the brine. As shown in FIG. 3, each of the heat absorbing members 2 has a housing 22 having sufficient heat conductivity and a brine passage 21 formed in the housing 22. The housing 22 is made of a heat conductive material, such as aluminum, aluminum alloy, copper, copper alloy, or the like.

The housing 22 has an inlet port 21*a* at a lower end and an outlet port 21*b* at an upper end. The brine passage 21 is formed such that air bubbles entering from the inlet port 21*a* are smoothly conducted toward the outlet port 21*b*. For example, the brine passage 21 has a repetitive U-turn shape, that is, a serpentine shape. Multiple passage portions are layered in an up and down direction, and ends of the multiple passage portions are connected to each other such that one continuous passage 21 is formed from the inlet port 21*a* to the outlet port 21*b*.

Accordingly, as shown by arrows in FIG. 3, the air bubbles entering from the inlet port 21*a*, which is located at a lower side, can be conducted to the outlet port 21*b*, which is located at an upper side.

Each of the electronic devices 25 is disposed to be closely in contact with an outer surface of the housing 22, so that the heat generated by the electronic device 25 is conducted to the housing 22. The heat conducted to the housing 22 is absorbed by the brine passing through the brine passage 21. Thus, the electronic device 25 is cooled by the brine.

Similar to the heat absorbing member 2, the heat radiating member 3 has a housing 32 having sufficient heat conductivity and a brine passage 31 formed in the housing 32, as shown in FIG. 3. The housing 32 is made of a heat conductive material, such as aluminum, aluminum alloy, copper, copper alloy, or the like.

The housing 32 has an inlet port 31*a* at a lower end and an outlet port 31*b* at an upper end. The brine passage 31 is formed such that air bubbles entering from the inlet port 31*a* are smoothly conducted toward the outlet port 31*b*. For example, the brine passage 31 has a repetitive U-turn shape, that is, a serpentine shape. Multiple passage portions are layered in an up and down direction, and ends of the multiple passage portions are connected to each other such that one continuous passage 31 is formed from the inlet port 31*a* to the outlet port 31*b*.

Although not illustrated, the heat radiating member 3 has a heat radiating fin on an outer surface of the housing 32. A fan 35 is provided to blow air toward the heat radiating fin of the heat radiating member 3. The heat radiating member 3 is disposed downstream of the heat absorbing members 2 with respect to the flow of the brine in the brine circuit 1. Thus, the heat of the brine, which has been transferred from the heat absorbing members 2, is conducted to the housing 32 and the heat radiating fin while the brine passes through the brine passage 31. The housing 32 and the heat radiating fin are cooled by the air generated by the fan 35. The heat absorbing members 2 and the heat radiating member 3 constitute a heat exchanger group (heat exchanger unit) 20.

The pump 4 is disposed downstream of the heat radiating member 3 with respect to the flow of brine. The pump 4 serves to force the brine, which has been cooled through the heat radiating member 3, to flow toward the heat absorbing members 2. Further, the pressure-reducing device 5 is provided on the brine circuit 1, between the pump 4 and the heat absorbing members 2. In the present embodiment, the pressure-reducing device 5 is constructed of a first tank 5*a* that is capable of storing the brine therein, and to reduce the pressure of the brine circuit 1 equal to or lower than atmospheric pressure.

The first tank 5*a* is an air open-type. That is, the first tank 5*a* is a container, and an upper portion of the container is open to the atmosphere. The first tank 5*a* has a brine inlet and a brine outlet under a liquid surface of the brine stored in the first tank 5*a*. The brine inlet is in communication with a discharge port of the pump 4. The brine outlet is in communication with the inlet port 21*a* of the heat absorbing member 2.

Since the first tank 5*a* is open to the atmosphere, it serves as a gas and liquid separating device. That is, the brine discharged from the outlet of the pump 4 is stored in the first tank 5*a*. In the first tank 5*a*, the velocity of the brine is reduced, and thus bubbles contained in the brine is separated from liquid brine.

The outlet of the first tank 5*a*, which is in communication with the inlet port 21*a* of the heat absorbing member 2, is located lower than the liquid surface of the brine in the first tank 5*a*. Accordingly, the brine circuit 1 is constructed as an air open-type circuit that is being open to the atmosphere.

In the present embodiment, the first tank 5*a* is constructed to be open to the atmosphere. Thus, the brine is stored in the first tank 5*a* at a pressure equal to the atmospheric pressure. As such, the pressure-reducing device 5, that is, the first tank 5*a* also serves as a pressure-equalizing device for controlling the pressure equal to the atmospheric pressure. The first tank 5*a* can be constructed in another way such that the pressure of the brine circuit 1 becomes equal to the atmospheric pressure. For example, the top portion of the first tank 5*a* is covered by a thin film member that is easily deformable such as rubber. In this case, a decrease in the brine due to evaporation in the first tank 5*a* is reduced.

FIG. 2 shows a change in pressure of the brine circuit 1. In FIGS. 1 and 2, point A corresponds to an inside of the first tank 5*a*, and point B corresponds to a suction port of the pump 4. As shown in FIG. 2, at the point A, the pressure is equal to the atmospheric pressure $P_0$ since the first tank 5*a* is open to the atmosphere. After flowing out from the first tank 5*a*, that is, in the heat exchanger group 20, the brine is suctioned by the pump 4. Therefore, the pressure of the brine circuit 1 is lower than the atmospheric pressure. In particular, the pressure of the brine circuit 1 is the lowest at the point B.

Although the pressure of the brine circuit 1 increases by a discharge pressure of the pump 4 downstream of the pump 4, the pressure becomes equal to the atmospheric pressure at the point A, that is, in the first tank 5*a*. As such, the brine is circulated in the brine circuit 1 in an order of the points A, B, A. Also, the pressure in the brine circuit 1 is maintained equal to or lower than the atmospheric pressure. That is, the brine circuit 1 including the heat exchanger group 20 is operated in a negative pressure mode in which the pressure of the brine circuit 1 at the heat exchanger group 20 is equal to or lower than the atmospheric pressure.

An operation of the cooling apparatus 10 will be described. The operation of the cooling apparatus is started by starting operations of the pump 4 and the fan 35. As the pump 4 is operated, the brine is circulated in the brine circuit 1 in the order of the points A, B, A. As the fan 35 is operated, the heat radiating member 3 is cooled by receiving the air from the fan 35.

In the heat absorbing members 2, the heat generated from the electronic devices 25 is absorbed by the brine. Thus, the electronic devices 25 are cooled. Thereafter, the brine, which has received the heat through the heat absorbing members 2, is cooled through the heat radiating member 3. The brine, which has been cooled through the heat radiating member 3, is further introduced to the heat absorbing members 2 through the first tank 5*a*. Accordingly, the electronic devise 5 are cooled by the circulation of the brine.

The brine circuit 1 is constructed such that the pressure inside of the heat exchanger group 20, including the heat absorbing members 2 and the heat radiating member 3, is equal to or less than the atmospheric pressure. That is, the brine passes through the heat exchanger group 20 at the pressure equal to or lower than the atmospheric pressure. Therefore, even if the brine passage in the heat exchanger group 20 is broken, it is less likely that the brine will leak from the brine passage. In this case, the brine will be drawn into the first tank 5*a* from a broken portion of the brine passage. Accordingly, the leakage of the brine from the brine circuit 1 will be reduced.

The heat absorbing members 2 and the heat radiating member 3 have the brine passages 21, 31. The outlet ports 21*b*, 31*b* of the brine passages 21, 31 are located higher than the inlet ports 21*a*, 31*a* of the brine passages 21, 31. Further, the brine passages 21, 31 are formed such that the air bubbles contained in the brine are smoothly conducted from the inlet ports 21*a*, 31*a* toward the outlet ports 21*b*, 31*b*. Therefore, if the brine passages 21, 31 are broken, it is easy to collect the brine in the first tank 5*a*.

Since the brine is effectively collected to the first tank 5*a*, the brine will not remain in the heat absorbing members 2 and the heat radiating member 3. Therefore, when the heat absorbing member 2 or the heat radiating member 3 is removed and is tilted, the brine will not drop.

Second Embodiment

Figure 4:
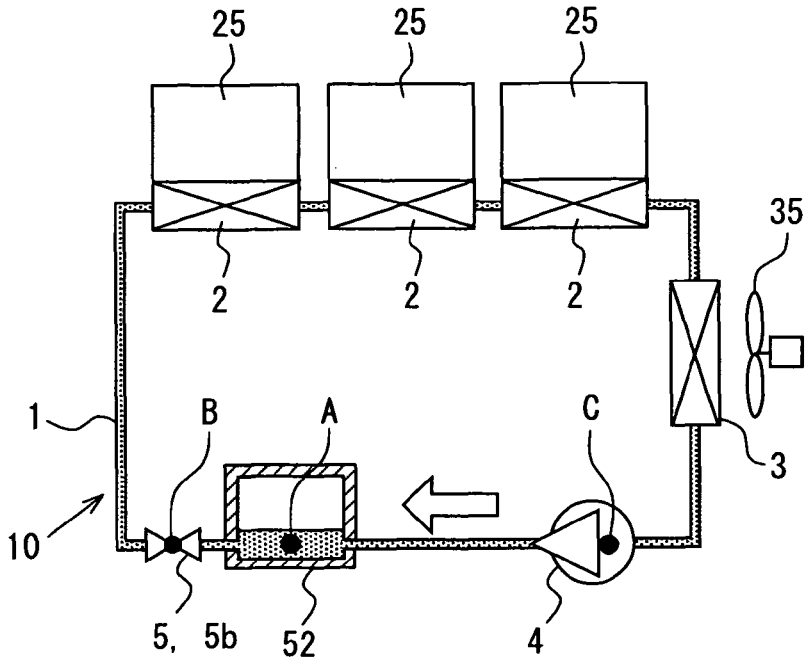
FIG. 4 is a schematic diagram of a cooling apparatus according to a second embodiment of the present invention.

Referring to FIG. 4, in the present embodiment, the cooling apparatus 10 includes a second tank 52 and a throttle valve 5*b* as the pressure-reducing device 5, in place of the first tank 5*a* of the first embodiment. The second tank 52 is a closed-type tank and is arranged downstream of the pump 4 and the throttle valve 5*b* is provided to reduce the pressure downstream of the second tank 52 equal to or lower than the atmospheric pressure. Thus, the brine circuit 1 is constructed such that the pressure at the heat exchanger group 20 is maintained equal to or lower than the atmospheric pressure.

The second tank 52 is arranged downstream of the pump 4, and the throttle valve 5*b* is arranged downstream of the pump 4, with respect to the flow of the brine in the brine circuit 1. The second tank 52 is provided to store the brine of the brine circuit 1 therein.

The second tank 52 is arranged between the pump 4 and the heat absorbing members 2. The second tank 52 is the closed-type tank, whose top portion is closed. The throttle valve 5*b* is arranged between the second tank 52 and the heat absorbing members 2. The throttle valve 5*b* serves as the pressure-reducing device for reducing the pressure of the brine discharged from the second tank 52, that is, suctioned from the second tank 52 equal to or lower than the atmospheric pressure. As such, the brine circuit 1 forms a closed circuit.

Figure 5:
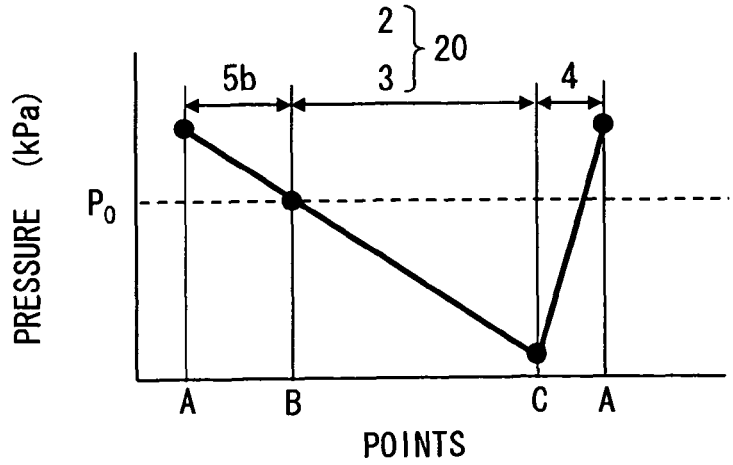
FIG. 5 is a graph showing a change in pressure of a brine circuit of the cooling apparatus shown in FIG. 4.

FIG. 5 shows a change of pressure in the brine circuit 1. In FIGS. 4 and 5, point A corresponds to the inside of the second tank 52, point B corresponds to the throttle valve 5*b*, and point C corresponds to the suction port of the pump 4.

Since the second tank 52 is the closed-type tank, the pressure inside of the second tank 52, that is, at the point A is equal to or higher than the atmospheric pressure. After being discharged from the second tank 52, the pressure is alleviated to the atmospheric pressure by the throttle valve 5*b*, that is, at the point B. At the heat exchanger unit 20, the pressure is lower than the atmospheric pressure due to the suction pressure of the pump 4. In particular, the pressure is the lowest at the suction port of the pump 4, that is, at the point C.

Downstream of the pump 4, the pressure of the brine circuit 1 is increased once by the discharge pressure of the pump 4, and is reduced to the atmospheric pressure at the point B by the throttle valve 5*b*. Thus, the brine is circulated through the brine circuit 1 in the order of points A, B, C, A such that the pressure at the heat exchanger group 20 is maintained equal to or lower than the atmospheric pressure. That is, the brine circuit 1 is operated in the negative pressure mode in which the internal pressure at the heat exchanger group 20 is equal to or lower than the atmospheric pressure.

As such, even if the brine passage of the heat exchanger group 20 has a breakage is broken, it is less likely that the brine will leak from the brine passage. When the brine passage is broken, the brine is drawn to the second tank 52 from the broken portion. Accordingly, it is less likely that the brine will leak from the brine circuit 1.

In the present embodiment, the brine circuit 1 is the closed circuit. The decrease in the brine due to evaporation is reduced.

Third Embodiment

FIGS. 6A to 6D show the cooling apparatus 10 of the third embodiment. In the first and second embodiments, the brine circuit 1 is constructed to be operated in the negative pressure mode such that the internal pressure is equal to or lower than the atmospheric pressure at the heat exchanger group 20. In the present embodiment, the brine circuit 1 is constructed such that the mode can be switched between the negative pressure mode and a positive pressure mode in which the internal pressure at the heat exchanger group 20 is higher than the atmospheric pressure.

Figure 6B:
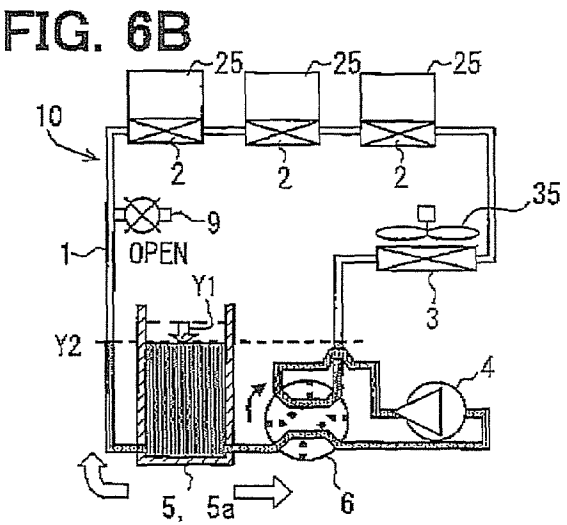
FIG. 6B is a schematic diagram of the cooling apparatus, when brine is introduced in a first tank, according to the third embodiment.
Figure 6E:
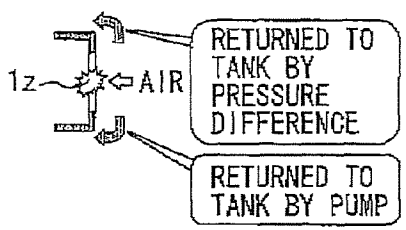
FIG. 6E is an explanatory view of a part VIE of a brine circuit of the cooling apparatus shown in FIG. 6D, when the brine circuit is broken, according to the third embodiment.
Figure 6A:
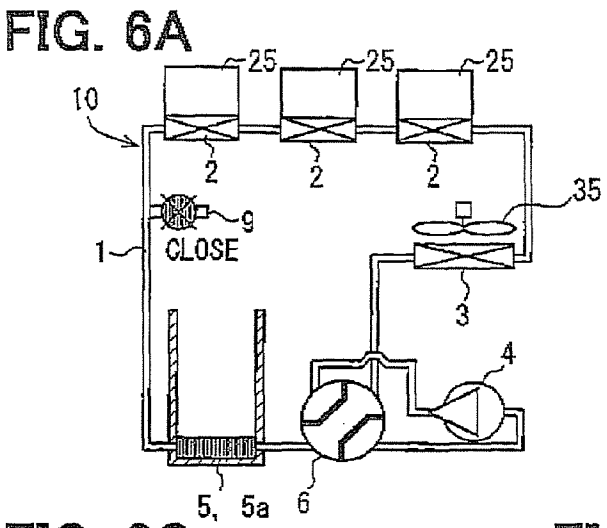
FIG. 6A is a schematic diagram of a cooling apparatus, during assembling, according to a third embodiment of the present invention.
Figure 6D:
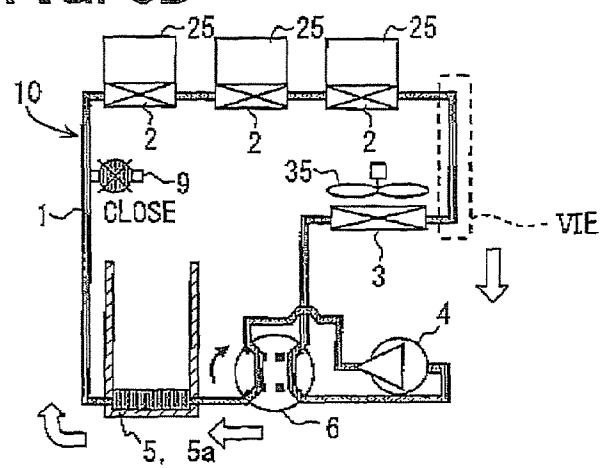
FIG. 6D is a schematic diagram of the cooling apparatus, in a negative pressure mode, according to the third embodiment.
Figure 6C:
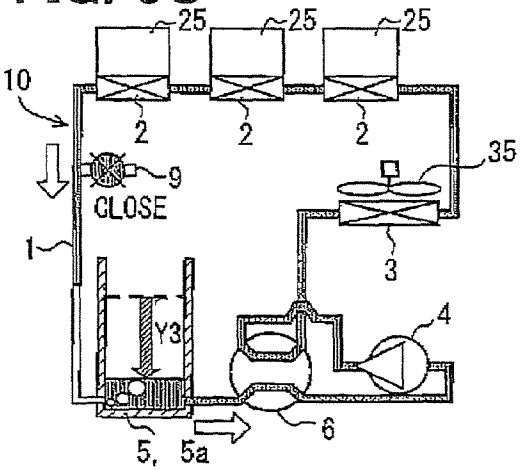
FIG. 6C is a schematic diagram of the cooling apparatus, in a positive pressure mode, according to the third embodiment.

FIG. 6A shows the cooling apparatus 10 during assembling. FIG. 6B shows the cooling apparatus when the brine is introduced in the brine circuit 1. FIG. 6C shows the cooling apparatus 10 in the positive pressure mode. FIG. 6D shows the cooling apparatus 10 in the negative pressure mode.

As shown in FIG. 6A, the brine circuit 1 is provided with a four-way valve 6 as a switching device and a purge valve 9 as an air releasing device. The four-way valve 6 is provided between the pump 4 and the first tank 5*a*. The purge valve 9 is provided between the first tank 5*a* and the heat absorbing members 2. The suction side of the pump 4 is arranged lower than the liquid surface of the brine stored in the first tank 5*a*. Therefore, on condition that the brine is stored in the first tank 5*a*, the brine can be introduced to the pump 4 due to hydraulic head of the brine in the first tank 5*a*.

The purge valve 9 serves to discharge the air bubbles from the brine circuit 1. As shown in FIG. 6B, the purge valve 9 is opened to the atmosphere when the brine is being introduced in the brine circuit 1. In the present embodiment, the purge valve 9 is employed as an example of the air releasing device. However, the air releasing device can be constructed of another mechanism, such as a mechanism that opens and closes the brine circuit 1 between the first tank 5*a* and the heat absorbing members 2.

The four-way valve 6 serves as the switching valve for switching a flow direction of the brine discharged from the pump 4. By the four-way valve 6, the flow of the brine discharged from the pump 4 can be directed either to the heat radiating member 3 or to the first tank 5*a*. The four-way valve 6 is controlled by a control device (not shown).

When the four-way valve 6 is switched to a first direction to direct the brine discharged from the pump 4 to the heat radiating member 3, as shown in FIG. 6C, the brine circuit 1 is in the positive pressure mode, so that the brine flows through the brine circuit 1 in the order of the pump 4, the heat radiating member 3, the heat absorbing members 2, the purge valve 9, the first tank 5*a*, the pump 4.

When the four-way valve 6 is switched to a second direction to direct the brine discharged from the pump 4 to the first tank 5*a*, as shown in FIG. 6D, the brine circuit 1 is operated in the negative pressure mode, so that the brines flows through the brine circuit 1 in the order of the pump 4, the first tank 5*a*, the purge valve 9, the heat absorbing members 2, the heat radiating member 3, the pump 4.

That is, the four-way valve 6 is provided between the ump 4 and the first tank 5*a*. The four-way valve 6 is capable of switching the flow direction of the brine by changing its position between a positive pressure mode position at which the suction side of the pump 4 is connected to the first tank 5*a* and the discharge side of the pump 4 is connected to the heat radiating member 3 and a negative pressure mode position at which the suction side of the pump 4 is connected to the heat radiating member 3 and the discharge side of the pump 4 is connected to the first tank 5*a*.

When the four-way valve 6 is in the positive pressure mode position, the cooling apparatus 10 is operated in the positive pressure mode such that the brine passes through the heat exchanger group 20 at a pressure higher than the atmospheric pressure. When the four-way valve 6 is in the negative pressure mode position, the cooling apparatus 10 is operated in the negative pressure mode such that the brine passes through the heat exchanger group 20 at the pressure equal to or lower than the atmospheric pressure. When the brine is to be introduced in the brine circuit 1, the cooling apparatus 10 is operated in the positive pressure mode. When the electronic devices 25 are cooled, the cooling apparatus 10 is operated in the negative pressure mode.

Next, a flow of the brine in the brine circuit 1 will be described with reference to FIGS. 6A, 6B, 6C, 6D and 6E. As shown in FIG. 6A, to fill the brine circuit 1 with the brine, the predetermined amount of the brine is introduced in the first tank 5*a*. At this time, the purge valve 9 is closed. Then, as shown in FIG. 6B, the four-way valve 6 is set to the positive pressure mode position such that the discharge side of the pump 4 is in communication with the heat radiating member 3. Next, the purge valve 9 is opened.

As such, the liquid surface of the brine in the first tank 5*a* is lowered as shown by an arrow Y1 of FIG. 6B That is, due to the hydraulic head of the brine in the first tank 5*a*, the brine is drawn to the pump 4 from the first tank 5*a* and is introduced in the part of the brine circuit 1, which is located lower than the liquid surface of the first tank 5*a*, that is, a dashed line Y2 in FIG. 6B.

Then, as shown in FIG. 6C, the purge valve 9 is closed and the pump 4 is operated. Accordingly, the brine is circulated in the order of the first tank 5*a*, the pump 4, and the heat exchanger group 20, the first tank 5*a*.

In this case, as shown in FIG. 6C, air bubbles in the heat exchanger group 20 are forced into the first tank 5*a* by means of the pump 4. Thus, the brine circuit 1 is filled with the brine. With this, the liquid surface of the brine in the first tank 5*a* is further lowered as shown by an arrow Y3 of FIG. 6C. That is, the brine is easily introduced in the brine circuit 1 without requiring vacuum drawing.

To cool the electronic devices 25, as shown in FIG. 6D, the four-way valve 6 is set to the negative pressure mode position such that the brine discharged from the pump 4 is directed to the first tank 5*a*. An operation of the cooling apparatus 10 is started by operating the pump 4 and the fan 35.

Accordingly, the brine is circulated through the brine circuit 1 in the order of the pump 4, the first tank 5*a*, the heat exchanger group 20, the pump 4. At this time, the heat generated from the electronic devices 25 is absorbed by the brine. Thus, the electronic devices 25 are cooled.

Further, the brine is cooled by the heat radiating member 3, and then is introduced to the heat absorbing members 2 through the first tank 5*a* by the pump 4. Accordingly, the electronic devices 25 are cooled by the circulation of the brine. In this case, the purge valve 9 is in the closed condition.

In the negative pressure mode, the internal pressure at the heat exchanger group 20 is equal to or lower than the atmospheric pressure. Therefore, even if the brine passage is broken between the heat absorbing member 2 and the heat radiating member 3, for example, as shown in FIG. 6E, the brine can be drawn to and collected in the first tank 5*a*. For example, the brine that is located upstream of a breakage 1*z* will be returned to the first tank 5*a* due to pressure difference. Also, the brine that is located downstream of the breakage 1*z* will be collected to the first tank 5*a* by the pump 4. Therefore, it is less likely that the brine will leak from the brine circuit 1.

Fourth Embodiment

Figure 7:
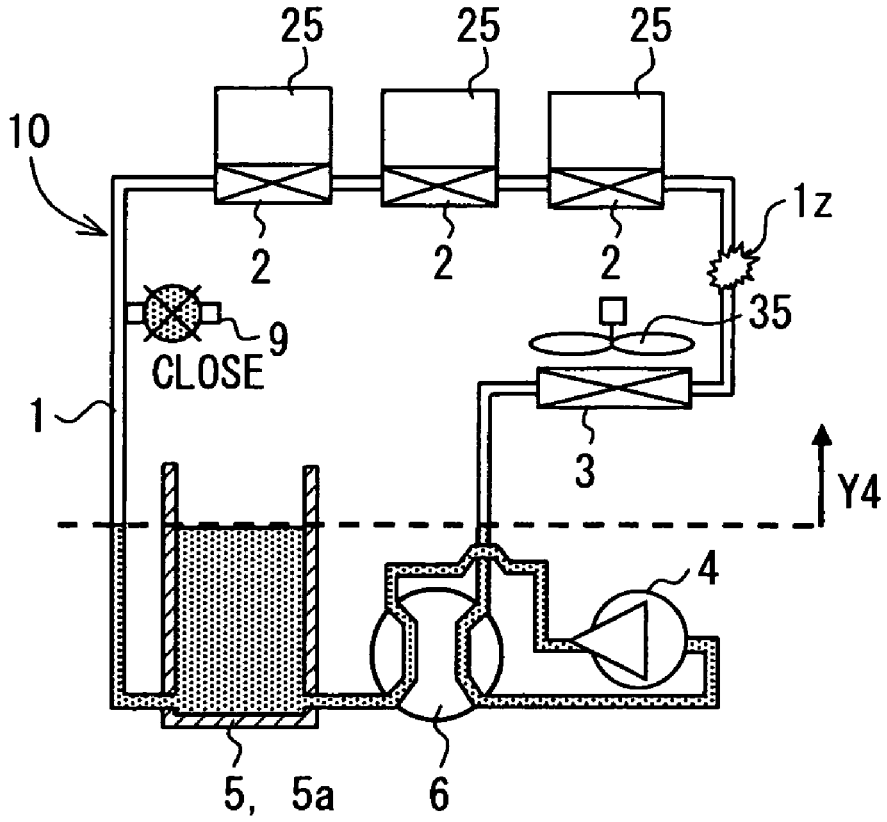
FIG. 7 is a schematic diagram of a cooling apparatus according to a fourth embodiment of the present invention.

Referring to FIG. 7, in the present embodiment, the cooling apparatus 10 has the similar structure as that of the third embodiment, but positional relationship between the first tank 5*a* and the heat exchanger group 20 is determined.

Specifically, the heat exchanger group 20 is arranged higher than the liquid surface of the brine in the first tank 5*a*. In this case, when the brine passage is broken in the heat exchanger unit 20 while the operation of the pump 4 is stopped, the brine is returned to the first tank 5*a* from the breakage 1*z*. Therefore, as shown in FIG. 7, a liquid surface Y4 of the first tank 5 is increased higher than that while the pump 4 is in the operation. Accordingly, it is less likely that the brine will leak from the brine circuit 1.

Fifth Embodiment

Figure 8B:
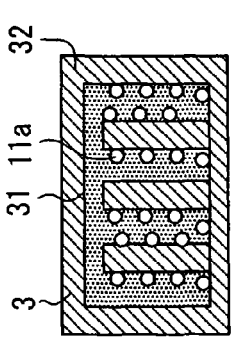
FIG. 8B is an enlarged cross-sectional view of the heat radiating member, in the condition of FIG. 8A, according to the fifth embodiment.
Figure 8D:
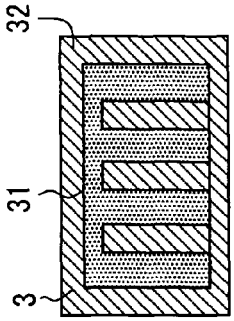
FIG. 8D is an enlarged cross-sectional view of the heat radiating member, in the condition of FIG. 8C, according to the fifth embodiment.
Figure 8A:
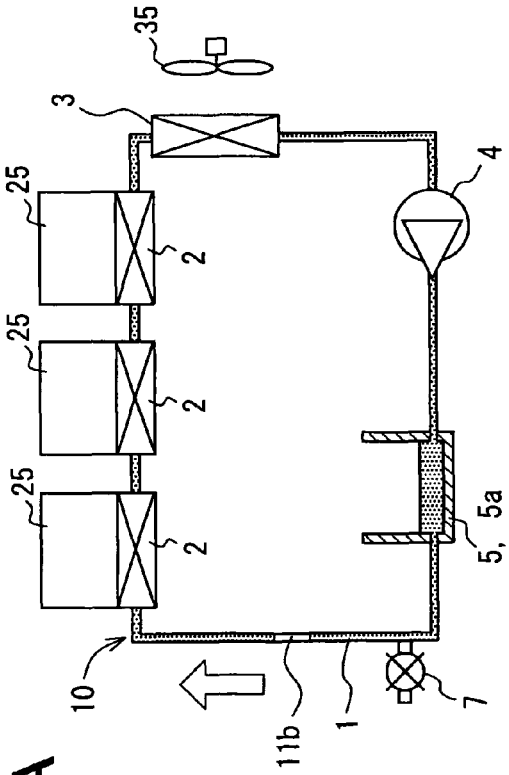
FIG. 8A is a schematic diagram of a cooling apparatus, in a condition before a large air bubble passes through heat absorbing members and a heat radiating member, according to a fifth embodiment of the present invention.
Figure 8C:
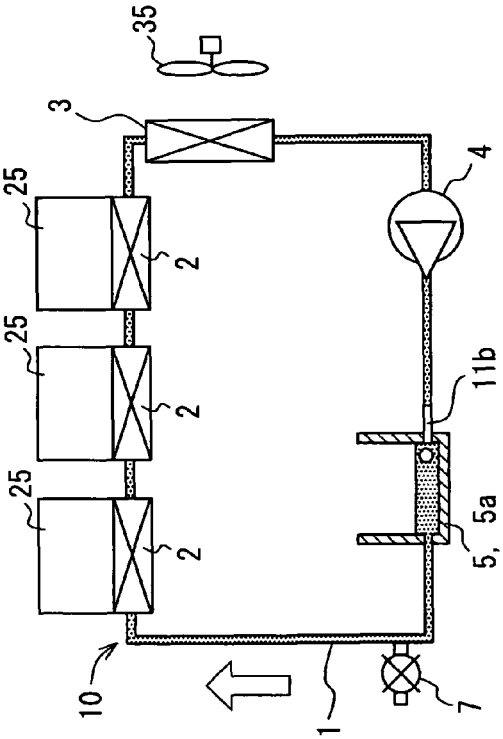
FIG. 8C is a schematic diagram of the cooling apparatus, in a condition after the large air bubble passed through the heat absorbing members and the heat radiating member, according to the fifth embodiment.

Referring to FIGS. 8A through 8D, in the present embodiment, the cooling apparatus 10 is constructed to improve efficiency of heat exchange of the heat exchanger group 20. FIG. 8A shows the cooling apparatus 10 in a condition before a large air bubble 11*b* passes through the heat exchanger group 20. FIG. 8B shows a part of the heat radiating member 3 in the condition shown in FIG. 8A. FIG. 8C shows the cooling apparatus 10 in a condition after the air bubble 11*b* passed through the heat exchanger group 20. FIG. 8D shows the part of the heat radiating member 3 in the condition shown in FIG. 8C.

In the present embodiment, the cooling apparatus 10 is provided with an air bubble introducing device 7 for introducing the air bubble 11*b* in the brine circuit 1. The air bubble introducing device 7 is arranged between the first tank 5*a* and the heat absorbing members 2. The air bubble introducing device 7 is, for example, a purge valve that is capable of being manually operated. The brine circuit 1 is operated in the negative pressure mode in which the pressure of the brine is equal to or lower than the atmospheric pressure at least at the heat exchanger group 20. When the air bubble introducing device 7 is opened to the atmosphere, the air bubble 11*b* is introduced in the brine circuit 1.

When the brine circuit 1 is operated in the negative pressure mode to cool the electronic devices 25, fine air bubbles 11*a* are adhered to inner surfaces of the housings 22, 32 of the heat absorbing members 2 and the heat radiating member 3, the inner surfaces forming the brine passages 21, 31, as shown in FIG. 8B. The fine air bubbles 11*a* may cause decrease in efficiency of heat exchange between the brine and the housings 22, 32.

Thus, in the present embodiment, the large air bubble 11*b* is introduced in the brine circuit 1 at a position upstream of the heat exchanger group 20. For example, the large air bubble 11*b* is introduced in the brine circuit 1 by opening the air bubble introducing device 7 between the first tank 5*a* and the heat absorbing members 2, as shown in FIG. 8A.

The large air bubble 11*b* passes through the heat exchanger group 20 and flows to the first tank 5*a*. While passing through the heat exchanger group 20, the large air bubble 11*b* induces the fine air bubbles 11*a*, and is collected in the first tank 5*a* with the fine air bubbles 11*a*.

As such, the fine air bubbles 11*a* in the heat exchanger group 20 are reduced. Accordingly, the efficiency of heat exchange of the heat exchanger group 20 improves. Also, it is less likely that the brine will leak from the air bubble introducing device 7. Further, the air bubble 11*b* is easily introduced in the brine circuit 1 by the air bubble introducing device 7.

Sixth Embodiment

Figure 9A:
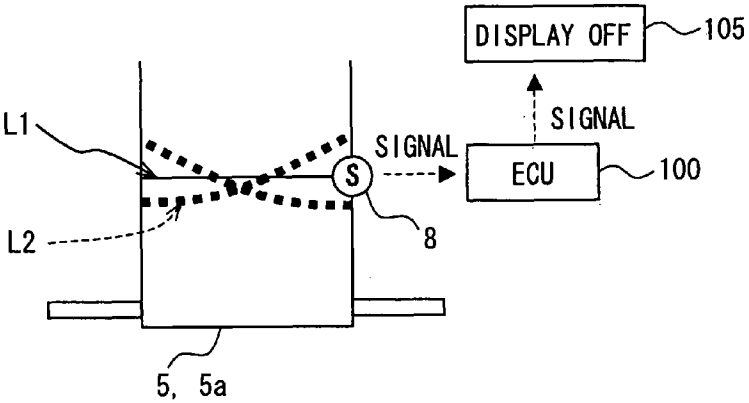
FIG. 9A is a schematic diagram of a brine monitoring and warning system of a cooling apparatus according to a sixth embodiment of the present invention.
Figure 9B:
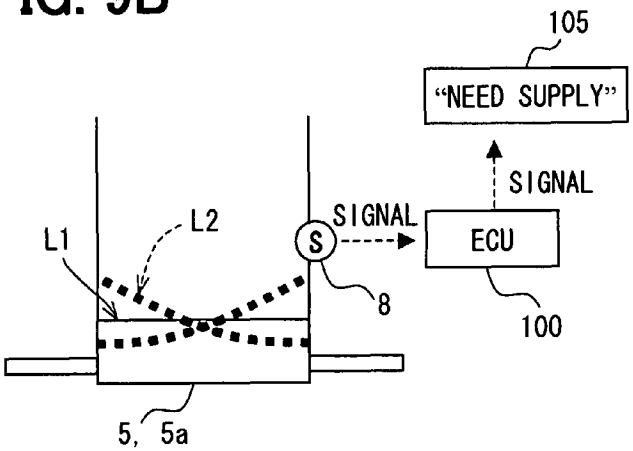
FIG. 9B is a schematic diagram of the brine monitoring and warning system, when a warning message "need supply" is displayed, according to the sixth embodiment.
Figure 9C:
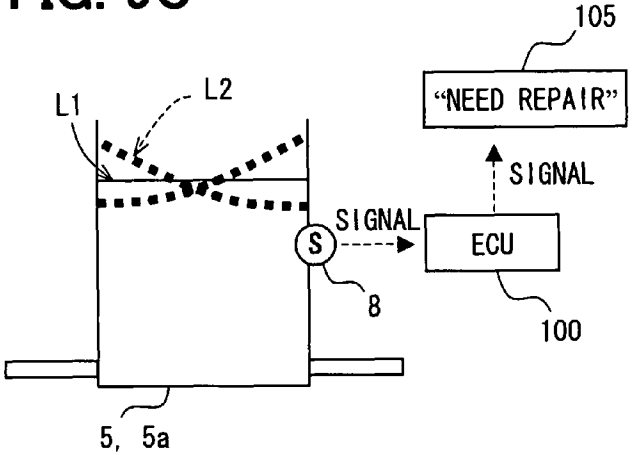
FIG. 9C is a schematic diagram of the brine monitoring and warning system, when a warning message "need repairing" is displayed, according to the sixth embodiment.

In the present embodiment, the cooling apparatus 10 is provided with a monitoring system for monitoring and warning the amount of brine filled in the brine circuit 1, as shown in FIGS. 9A through 9C. The monitoring system monitors the amount of brine in the brine circuit 1 and determines whether the amount of brine is appropriate or not. The monitoring system further generates a warning based on a determination result.

For example, the monitoring system includes a liquid level sensor 8, a control unit 100 and a display unit 105 as a warning device. The liquid level sensor 8 detects the liquid surface level of the brine stored in the first tank 5*a*. The control unit 100 includes an electronic control circuit and determines whether the amount of brine in the first tank 5*a* is appropriate or not based on a detection signal of the liquid level sensor 8. The display unit 105 displays the determination result of the control unit 100.

In the present embodiment, the cooling apparatus 10 is employed in a vehicle, for example. While an engine of the vehicle is stopped, that is, while the engine is off, the liquid surface of the first tank 5*a* is stable, as shown by a solid line L1 in FIG. 9A. Thus, it is easy to detect the liquid surface level.

While the engine is in operation, that is, while the engine is on, the liquid surface of the first tank 5*a* fluctuates due to vibrations of the vehicle, as shown by dashed lines L2 in FIG. 9A. In the present embodiment, therefore, the first tank 5*a* is provided with the single liquid level sensor 8. The liquid level sensor 8 is connected to the control unit 100 such that the signal indicative of the detected liquid surface level is sent to the control unit 100.

The control unit 100 is provided with a control program that is capable of determining whether repairing of the brine circuit 1 or supplying of the brine is needed and outputting signals indicative of the determination results to the display device 105. The display device 105 is capable of indicating the necessity of the repairing of the brine circuit 1 or the supplying of the brine. For example, the display device 105 displays warnings such as "need supply" and "need repair", as shown in FIGS. 9B and 9C.

When the amount of brine in the brine circuit 1 is less than a predetermined amount, for example, when the liquid surface of the brine in the first tank 5*a* is lower than the liquid level sensor 8, it is determined that the supplying of the brine is necessary. Thus, the warning "need supply" is displayed. In this case, the brine needs to be supplied in the first tank 5*a* such that the liquid surface level becomes a predetermined level.

In a case where the brine circuit 1 is broken adjacent to the heat exchanger group 20, the liquid surface level of the brine in the first tank 5*a* increases. Therefore, when the liquid surface level of the brine is higher than the liquid level sensor 8, it is determined that the brine circuit 1 has a broken portion. Thus, the warning "need repairing" is displayed.

Figure 10:
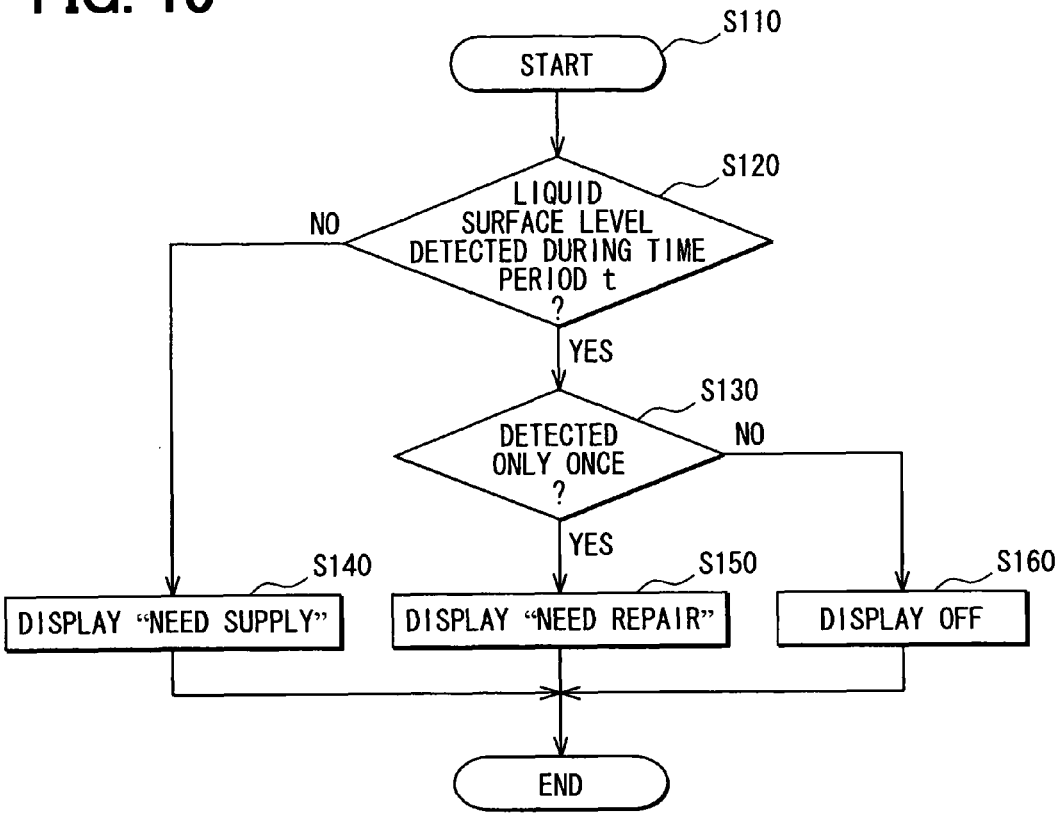
FIG. 10 is a flowchart showing a processing executed by a control unit of the brine monitoring and warning system according to the sixth embodiment.

Next, a processing of the control program of the control unit 100 will be described with reference to FIG. 10. At S110, the processing is started. At S120, it is determined whether or not the liquid surface level has been detected by the liquid level sensor 8 during a predetermined period of time t since the processing is started. When it is determined that the liquid surface level has been detected at least once, the processing proceeds to S130.

When it is determined at S120 that the liquid surface level has not been detected, it is determined that the amount of the brine is less than the predetermined amount. Thus, at S140, the signal indicative of the insufficiency of the brine is outputted to the display device 105 to display the warning "need supply".

At S130, it is determined how many times the liquid surface level has been detected. When it is determined at S130 that the liquid surface was detected only once, it is determined that the repairing of the brine circuit 1 is necessary. Thus, at S150, the signal indicative of the necessity of the repairing is outputted to the display device 105 to display the warning "need repair".

When it is determined at S130 that the liquid surface was detected twice or more than twice, it is determined that the brine circuit is in normal condition. Thus, at S160, a command signal "display off" is outputted to the display device 105. As such, the display device 105 does not display the warning.

Accordingly, the conditions of the brine circuit 1 and the amount of the brine are easily monitored. In the case where the amount of brine is in sufficient, it can be warned immediately. Also, since the warning "need repair" or "need supply" is displayed, it is easy to judge whether the brine circuit 1 has a defect such as a breakage or not. When the warning "need supply" is displayed, it is possible to make the cooling apparatus 10 in the normal condition by adding the brine.

When the liquid surface level of the brine in the first tank 5*a* is on the predetermined level, it is determined that the cooling apparatus 10 is normally operated. When the liquid surface level of the brine in the first tank 5*a* is lower than the predetermined level, it is determined that the amount of brine is insufficient. Also, when there is a defect, such as a breakage, in the brine circuit 1 lower than the liquid surface of the firs tank 5*a*, the liquid surface level is likely to be lowered.

In the cooling apparatus 10 of the present embodiment, the heat exchanger group 20 is located higher than the first tank 5*a*. Therefore, if the brine passage of the heat exchanger unit 20 has a breakage, the brine in the heat exchanger group 20 returns the first tank 5*a*, as described in the third and fourth embodiments. In this case, the liquid surface of the brine in the first tank 5*a* becomes higher than the predetermined level. Accordingly, it is possible to determine that the brine passage of the heat exchange group 20 has the breakage.

Seventh Embodiment

Figure 11:
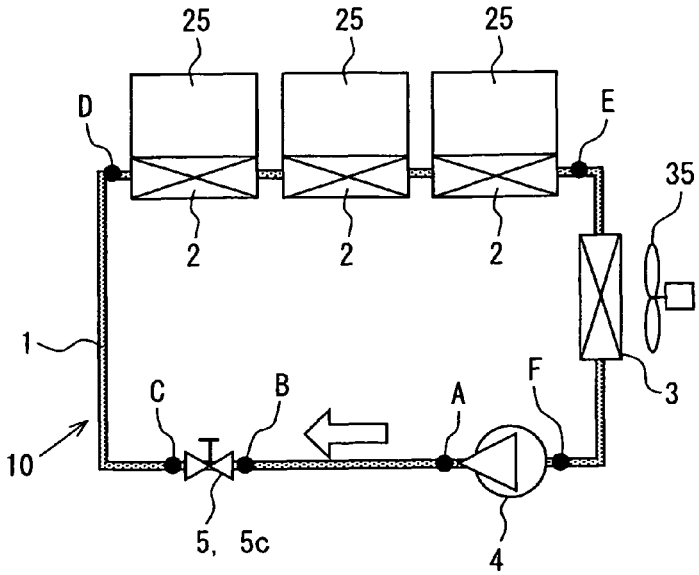
FIG. 11 is a schematic diagram of a cooling apparatus according to a seventh embodiment of the present invention.

Referring to FIG. 11, in the present embodiment, the cooling apparatus 10 has a passage control valve 5*c* as the pressure-reducing device 5. In the cooling apparatus 10, the heat absorbing members 2, the heat radiating member 3, the pump 4 and the passage control valve 5*c* are connected in order through the looped brine circuit 1.

The passage control valve 5*c* is arranged between the pump 4 and the heat absorbing members 2. Namely, the passage control valve 5*c* is in communication with the discharge side of the pump 4 and the inlet side of the heat absorbing members 2. The passage control valve 5*c* serves to reduce the pressure of the brine discharged from the pump 4. In other words, the passage control valve 5*c* is a decompressing member that is capable of increasing and decreasing a passage area. The passage control valve 5*c* is capable of reducing the pressure downstream of the pump 4 equal to the atmospheric pressure. By means of the passage control valve 5*c*, the internal pressure of the brine passage at the heat exchanger group 20 is equal to or lower than the atmospheric pressure.

Figure 12:
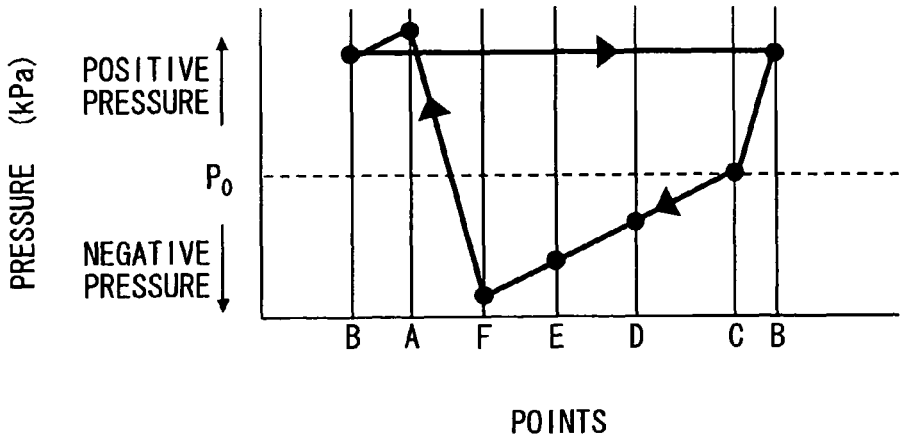
FIG. 12 is a graph showing a change in pressure of a brine circuit of the cooling apparatus shown in FIG. 11.
Figure 13:
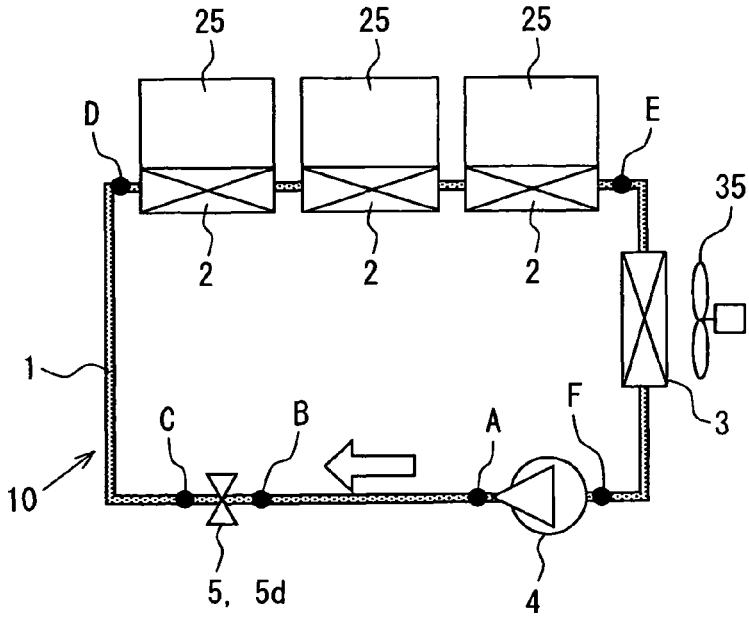
FIG. 13 is a schematic diagram of a cooling apparatus according to an eighth embodiment of the present invention.

FIG. 12 shows a change in pressure of the brine circuit 1. In FIGS. 11 and 12, point A corresponds to the discharge side of the pump 4, point B corresponds to an inlet side of the passage control valve 5*c*, and point C corresponds to an outlet side of the passage control valve 5*c*. Also, point D corresponds to an inlet side of the heat absorbing members 2, and point E corresponds to an outside side of the heat absorbing members 2. Point F corresponds to the suction side of the pump 4.

As shown in FIG. 12, at the point A, the pressure is a positive pressure that is higher than the atmospheric pressure. The pressure is the highest at the point A in the brine circuit 1. The pressure reduces from the point A toward the point B because of passage resistance between the point A and the point B.

At the point C, the pressure is equal to the atmospheric pressure. That is, the pressure is reduced to the atmospheric pressure by means of the control valve 5. The pressure reduces from the point C toward the point D because of the passage resistance between the point C and the point D. Further, the pressure from the point D toward the point E because of the passage resistance in the heat absorbing members 2. Accordingly, the pressure is maintained lower than the atmospheric pressure in the passage between the point D and the point E where the heat absorbing members 2 are arranged.

The pressure further reduces from the point E toward the point F because of passage resistance in the heat radiating member 3 and the brine passage between the point E and the point F. That is, the pressure is the lowest at the point F in the brine circuit 1. The brine at the point F is drawn to the point A by the operation of the pump 4. Thus, the pressure increases from the point F toward the point A by means of the pump 4.

Accordingly, the brine circulates through the brine circuit 1 in the order of points A, B, C, D, E, F, A. The pressure of the brine circuit 1 between the point D and the point F on which the heat absorbing members 2 and the heat radiating member 3 are arranged is maintained lower than the atmospheric pressure. That is, the cooling apparatus 10 is operated in the negative pressure mode in which the internal pressure of the brine circuit 1 at least at the heat absorbing members 2 and the heat radiating member 3 is equal to or lower than the atmospheric pressure.

Also in the present embodiment, even if the brine passage of the heat exchanger group 20 is broken, it is less likely that the brine will leak from the brine passage. Accordingly, the leakage of the brine from the brine circuit 1 is restricted. Since the leakage of the brine is restricted, even if the heat absorbing member 2 is broken, it is less likely that the electronic devices 25 will be short-circuited.

Eighth Embodiment

Figure 14:
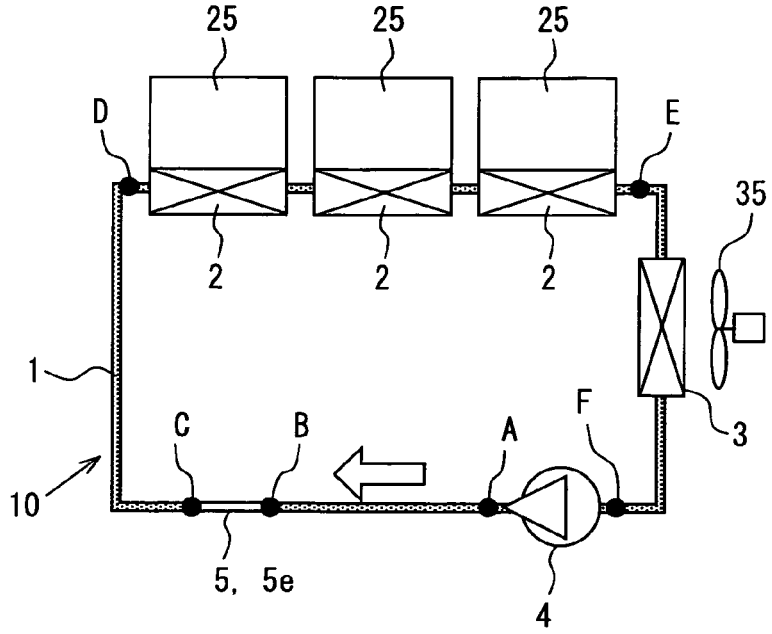
FIG. 14 is a schematic diagram of a cooling apparatus according to a ninth embodiment of the present invention.

Referring to FIG. 14, in the present embodiment, the cooling apparatus 10 has an orifice 5*d* as the pressure-reducing device 5, in place of the passage control valve 5*c* of the seventh embodiment. The cooling apparatus 10 has the heat absorbing members 2, the heat radiating member 3, the pump 4 and the orifice 5*d*, which are connected in this order through the looped brine circuit 1.

The orifice 5*d* is arranged between the pump 4 and the heat absorbing members 2. Namely, the orifice 5*d* is in communication with the discharge side of the pump 4 and the inlet side of the heat absorbing members 2. The orifice 5*d* serves as a throttle valve for reducing the pressure of the brine discharged from the pump 4. In other words, the orifice 5*d* is a decompressing member that is capable of immediately reducing the passage area, thereby to reduce the pressure equal to the atmospheric pressure.

In the present embodiment, the pressure varies in the similar manner as that of the seventh embodiment shown in FIG. 12. Accordingly, similar to the seventh embodiment, the pressure of the brine passage at the heat exchanger group 20, which is located downstream of the orifice 5*d*, is equal to or lower than the atmospheric pressure.

Ninth Embodiment

Referring to FIG. 14, in the present embodiment, the cooling apparatus 10 has a capillary tube 5*e* as the pressure-reducing device 5 for decompressing the brine discharged from the pump 4, in place of the passage control valve 5*c* of the seventh embodiment. In the cooling apparatus 10, the heat absorbing members 2, the heat radiating member 3, the pump 4 and the capillary tube 5*e* are connected in this order through the looped brine circuit 1.

The capillary tube 5*e* is arranged between the pump 4 and the heat absorbing members 2. Namely, the capillary tube 5*e* is in communication with the discharge side of the pump 4 and the inlet side of the heat absorbing members 2. The capillary tube 5*e* serves as an orifice tube for decompressing the brine discharged from the pump 4. The capillary tube 5*e* is a decompressing member that is capable of increasing passage resistance due to pipe friction. The capillary tube 5*e* serves as a decompressing valve that is capable of reducing the pressure equal to the atmospheric pressure.

In the present embodiment, the pressure varies in the similar manner as shown in FIG. 12. Accordingly, similar to the seventh and eighth embodiments, the pressure of the brine passage at the heat exchanger group 20, which is located downstream of the capillary tube 5*e*, is equal to or lower than the atmospheric pressure.

Tenth Embodiment

Figure 15:
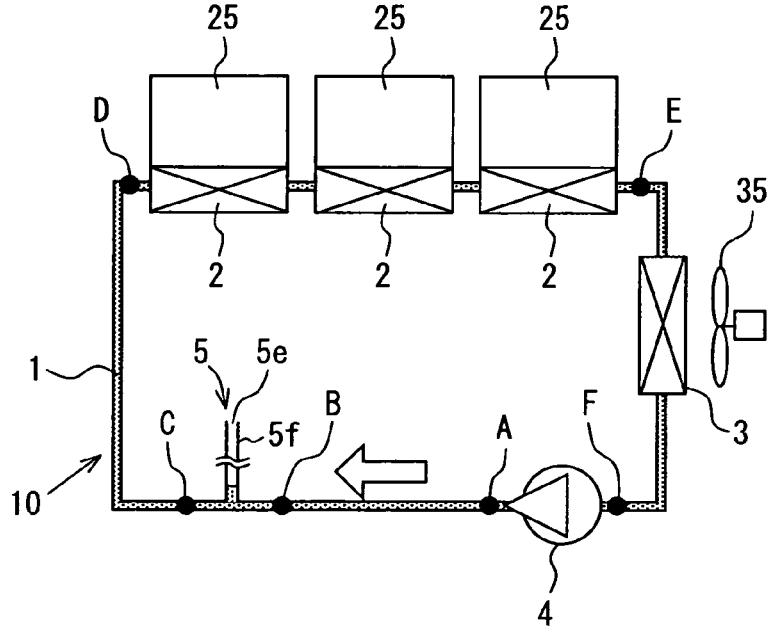
FIG. 15 is a schematic diagram of a cooling apparatus according to a tenth embodiment of the present invention.

Referring to FIG. 15, in the cooling apparatus 10 of the present embodiment, the pressure downstream of the pump 4 is reduced to the atmospheric pressure using the pressure-equalizing device as an example of the pressure reducing device 5, in place of the pressure-reducing device 5 such as the passage control valve 5*c*, the orifice 5*d*, and the capillary tube 5*e* of the seventh to ninth embodiments. In the cooling apparatus 10, the heat absorbing members 2, the heat radiating member 3, the pump 4 and the pressure-equalizing device 5 are connected in this order through the looped brine circuit 1. The pressure-equalizing device 5 includes a pipe 5*f*.

The pipe 5*f* has an opening 5*e* at one end, and an opposite end of the pipe 5*f* is connected to the brine circuit 1. The pipe 5*f* is connected perpendicular to the brine circuit 1, and has a predetermined height corresponding to the discharge pressure of the pump 4. The opening 5*e* is provided at the upper end of the pipe 5*f*. The pipe 5*f* is arranged between the pump 4 and the heat absorbing members 2. That is, the pipe 5*f* is located on the discharge side of the pump 4 and the upstream side of the heat absorbing members 2.

The pressure-equalizing device 5 is constructed such that the pressure of the brine in the pipe 5*f* becomes equal to the atmospheric pressure. The pressure-equalizing device 5 forms a contact portion where the brine of the brine circuit 1 contacts the outside air, that is, the atmosphere. The opening 5*e* allows the brine in the pipe 5*f* to communicate with the outside air, that is, the atmosphere.

As such, the pressure of the brine discharged from the pump 4 is reduced to the atmospheric pressure. In the present embodiment, the pressure varies in the similar manner as shown in FIG. 12. Accordingly, similar to the seventh embodiment, the pressure of the brine passage at the heat exchanger group 20, which is located downstream of the pipe 5*f*, is equal to or lower than the atmospheric pressure.

Eleventh Embodiment

Figure 16:
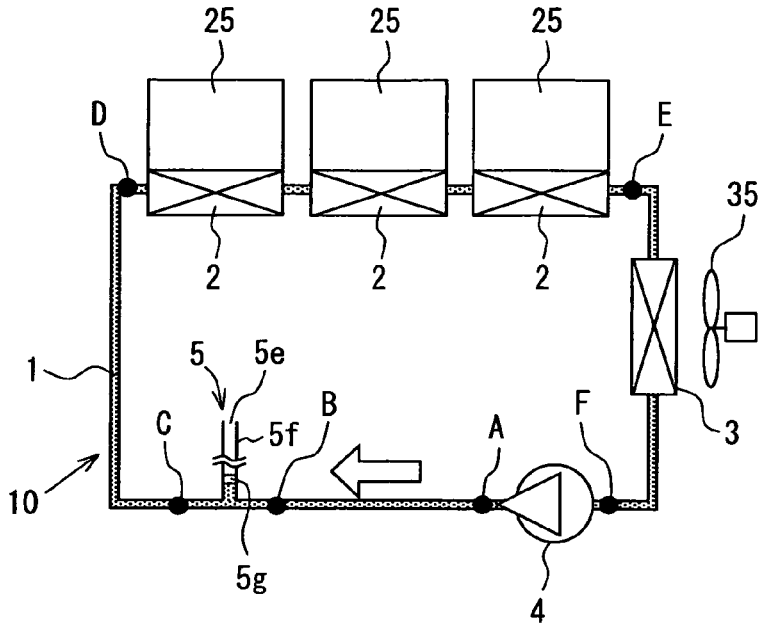
FIG. 16 is a schematic diagram of a cooling apparatus according to an eleventh embodiment of the present invention.

Referring to FIG. 16, in the cooling apparatus 10 of the present embodiment, the pressure-equalizing device 5 has a movable member 5*g* between the brine of the brine circuit 1 and the outside air.

In the cooling apparatus 10, the heat absorbing members 2, the heat radiating member 3, the pump 4 and the pressure-equalizing device 5 are connected in this order in the form of loop through the brine circuit 1. The pressure-equalizing device 5 includes the pipe 5*f* having the opening 5*e* and the movable member 5*g*. The movable member 5*g* is disposed to be movable with a liquid surface of the brine in the pipe 5*f*. The brine of the brine circuit 1 contacts the outside air through the movable member 5*g*.

The movable member 5*g* is a member capable of floating on the liquid surface of the brine in the pipe 5*f*, such as an oil film, a cover, a rubber sheet and the like. Because the brine in the pipe 5*f* is not directly exposed to the outside air, the decrease in the brine due to natural evaporation is effectively reduced, as compared with the structure of the tenth embodiment.

Accordingly, the pressure of the brine discharged from the pump 4 can be reduced to the atmospheric pressure. In the present embodiment, the pressure varies in the similar manner as shown in FIG. 12. Accordingly, similar to the seventh embodiment, the pressure of the brine passage at the heat exchanger group 20, which is located downstream of the pressure-equalizing device 5, is equal to or lower than the atmospheric pressure.

Twelfth Embodiment

Figure 17:
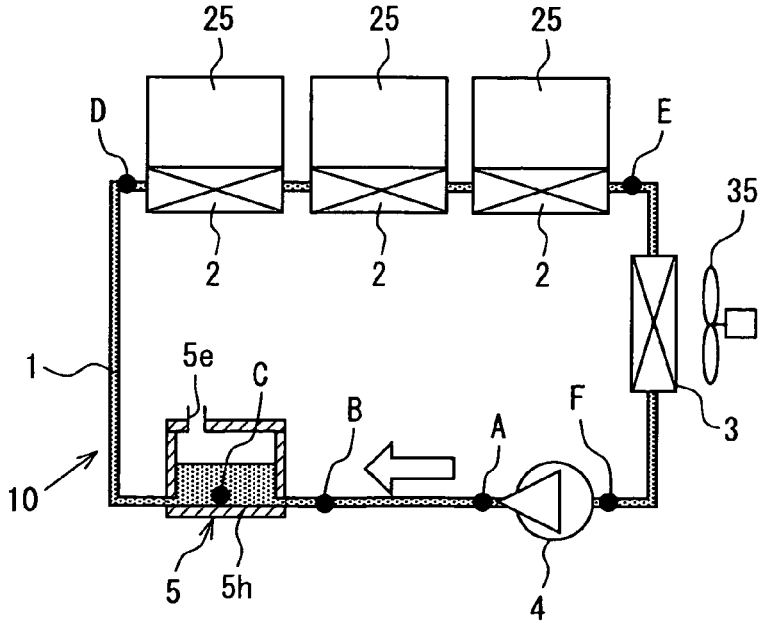
FIG. 17 is a schematic diagram of a cooling apparatus according to a twelfth embodiment of the present invention.

Referring to FIG. 17, in the present embodiment, the cooling apparatus 10 has a third tank 5*h* as the pressure-equalizing device 5, in place of the first tank 5*a* of the first embodiment.

In the cooling apparatus 10, the heat absorbing members 2, the heat radiating member 3, the pump 4 and the third tank 5*h* of the pressure-equalizing device 5 are connected in this order in the form of loop through the brine circuit 1. The third tank 5*h* has the opening 5*e*. The third tank 5*h* has an inlet port that is in communication with the discharge side of the pump 4 and an outlet port that is in communication with the inlet side of the heat absorbing members 2.

In this case, the third tank 5*h* has a lid at a top portion, and the opening 5*e* is formed on the lid. Therefore, the inside of the third tank 5*h* is communicated with the outside of the third tank 5*h* through the opening 5*e*. As such, the decrease in the brine due to the natural evaporation is reduced more than that of the first embodiment.

Also in the present embodiment, the pressure-equalizing device 5 can have the movable member 5*g* that floats on the liquid surface of the brine in the third tank 5*h*, similar to the movable member 5*g* of the eleventh embodiment. In this case, the decrease in the brine due to the natural evaporation is further effectively reduced.

In the present embodiment, the pressure varies in the similar manner as shown in FIG. 12. Accordingly, similar to the seventh embodiment, the pressure of the brine passage at the heat exchanger group 20, which is located downstream of the third tank 5*h*, is equal to or lower than the atmospheric pressure.

Thirteenth Embodiment

Figure 18:
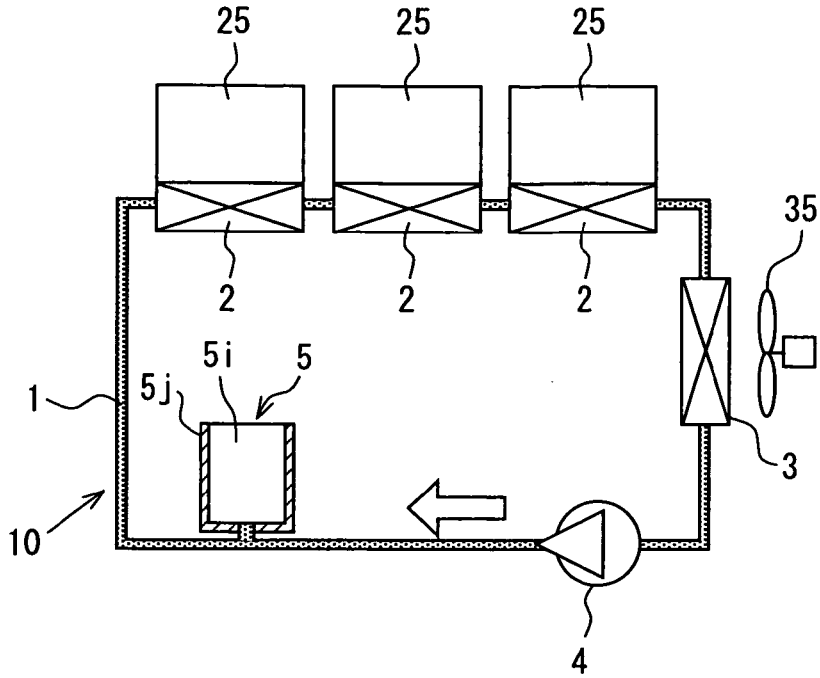
FIGS. 18 and 19 are a schematic diagram of a cooling apparatus according to a thirteenth embodiment of the present invention.
Figure 19:
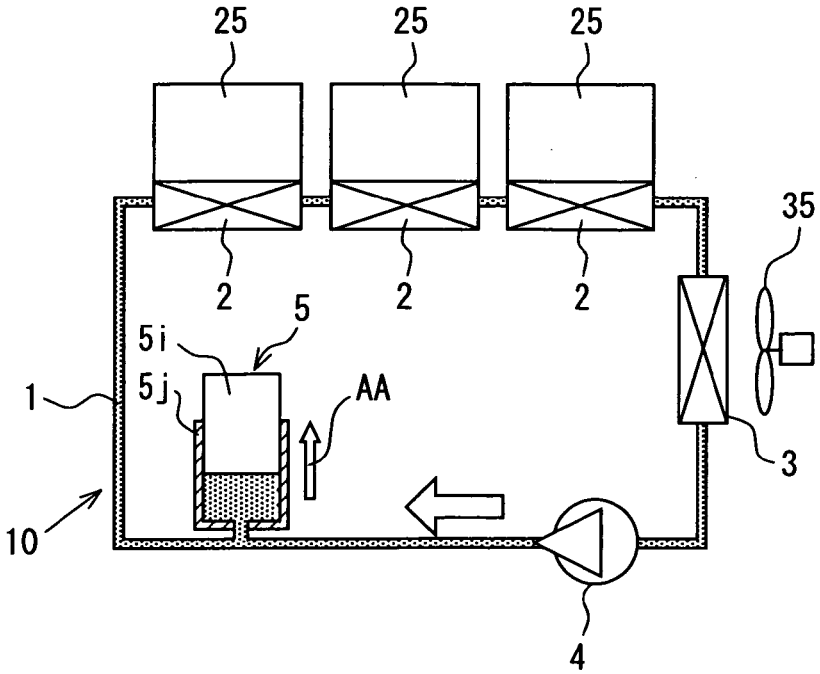

Referring to FIGS. 18 and 19, the cooling apparatus 10 of the present embodiment has a pressure changing device as another example of the pressure reducing device 5 for controlling the pressure at the heat exchanger group 20 equal to or lower than the atmospheric pressure. FIG. 18 shows the cooling apparatus 10 before the pressure changing device 5 is operated when the brine is introduced in the brine circuit 1. FIG. 19 shows the cooling apparatus 10 after the pressure changing device 5 is operated.

The cooling apparatus 10 has the heat absorbing members 2, the heat radiating member 3, the pump 4 and the pressure changing device 5, which are connected in this order in the form of loop through the brine circuit 1. The pressure changing device 5 has a cylinder 5*j* as a container and a piston 5*i*. An end of the cylinder 5*j* is connected to the brine circuit 1. The piston 5*i* makes reciprocating motion in the cylinder 5*j*.

The pressure changing device 5 is arranged between the pump 4 and the heat absorbing members 2. That is, the pressure changing device 5 is in communication with the discharge side of the pump 4 and the inlet side of the heat absorbing members 2. When the brine is introduced in the brine circuit 1, as shown in FIG. 18, the piston 5*i* is located in the cylinder 5*j*. After the brine is introduced in the brine circuit 1, the piston 5*i* is moved upward by an external force, as shown by an arrow AA in FIG. 19.

As a result, the volume of the brine circuit 1 occupied with the brine is increased after the brine was introduced in the brine circuit 1. That is, by pulling the piston 5*i* by the external force, the volume of the brine circuit 1 occupied with the brine becomes larger than the volume of the brine circuit 1 when the brine is introduced in the brine circuit 1. Accordingly, the pressure of the brine passage at the heat exchanger group 20, which is located downstream of the pressure changing device 5 is equal to or lower than the atmospheric pressure.

Fourteenth Embodiment

In the third and fourth embodiments, the cooling apparatus 10 has the first tank 5*a*, which is opened to the atmosphere, as the pressure-equalizing device as the example of the pressure-reducing device 5. In the present embodiment, the cooling apparatus 10 has the third tank 5*h* as the pressure-equalizing device 5 as shown in FIGS. 20A to 20D.

Figure 20A:
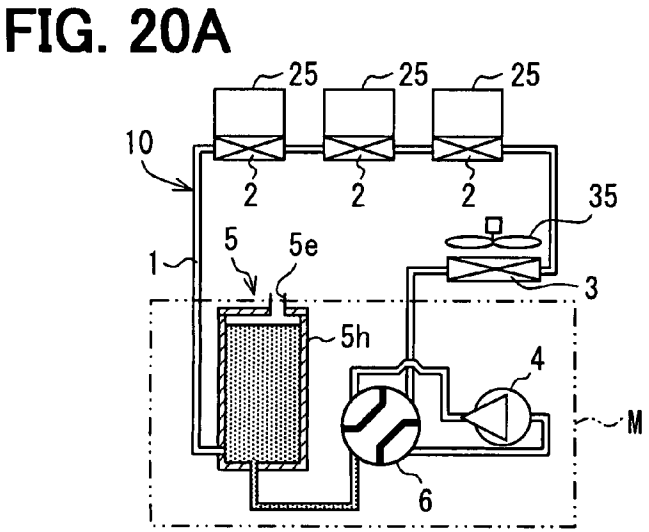
FIG. 20A is a schematic diagram of a cooling apparatus, during assembling, according to a fourteenth embodiment of the present invention.
Figure 20B:
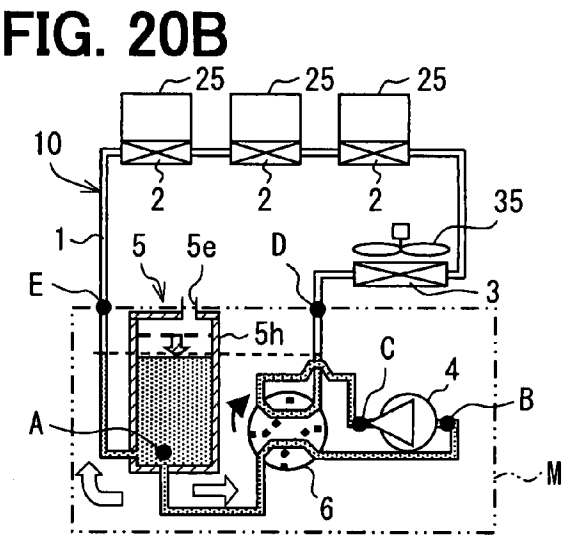
FIG. 20B is a schematic diagram of the cooling apparatus, when brine is introduced in a third tank, according to the fourteenth embodiment.
Figure 20C:
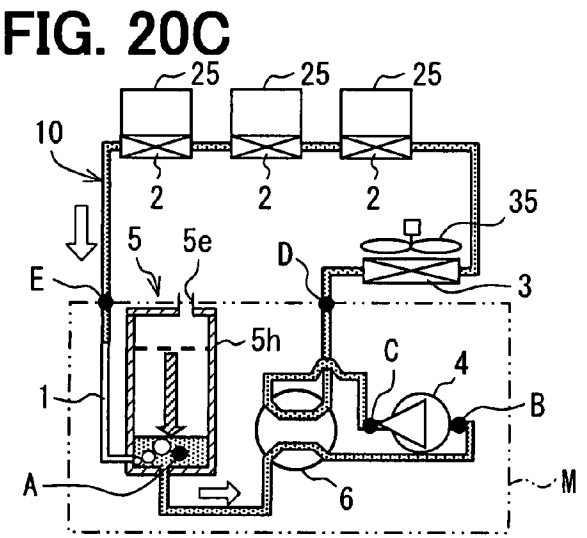
FIG. 20C is a schematic diagram of the cooling apparatus, in a positive pressure mode, according to the fourteenth embodiment.
Figure 20D:
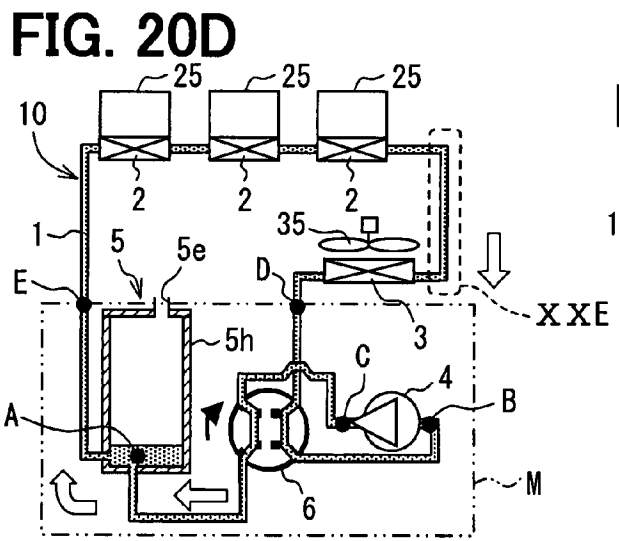
FIG. 20D is a schematic diagram of the cooling apparatus, in a negative pressure mode, according to the fourteenth embodiment.

FIG. 20A shows the cooling apparatus 10 when it is assembled. FIG. 20B shows the cooling apparatus 10 when the brine is introduced in the brine circuit 1. FIG. 20C shows the cooling apparatus 10 when the brine circuit 1 is in the positive pressure mode. FIG. 20D shows the cooling apparatus 10 when the brine circuit 1 is in the negative pressure mode.

The cooling apparatus 10 of the present embodiment is constructed such that the operation mode can be switched between the negative pressure mode and the positive pressure mode, similar to the third and fourth embodiments. For example, the cooling apparatus 10 has the four-way valve 6 between the pump 4 and the pressure-equalizing device 5, as shown in FIGS. 20A through 20D. In the third and fourth embodiments, the cooling apparatus 10 is provided with the purge valve 9 between the first tank 5*a* and the heat absorbing members 25. However, the purge valve 9 can be eliminated.

Here, the components included in a double-dashed chain line M, such as the pressure-equalizing device 5, the pump 4 and the four-way valve 6, are integrated into a module. The heat exchanger group 20 is arranged higher than the module M.

Figure 21A:
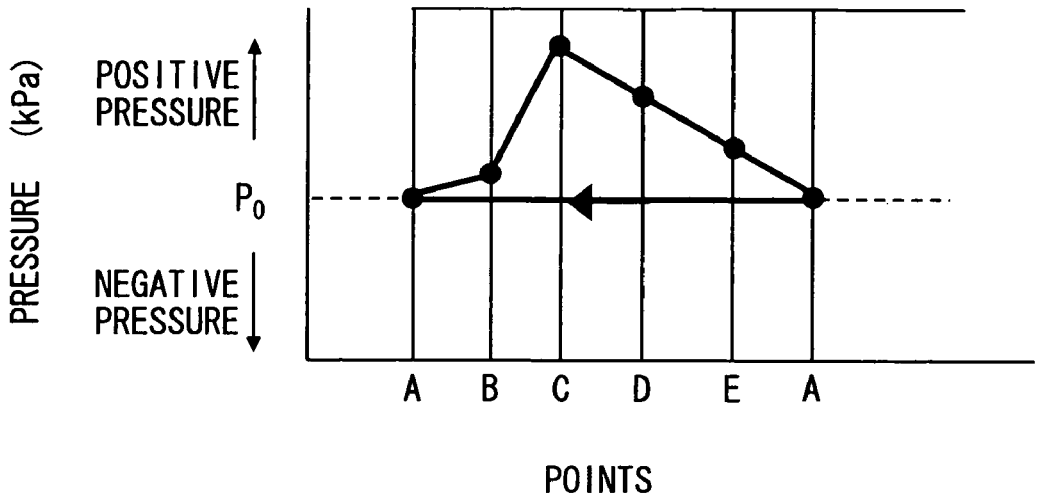
FIG. 21A is a graph showing a change in pressure of the brine circuit in the positive pressure mode shown in FIG. 20C.
Figure 21B:
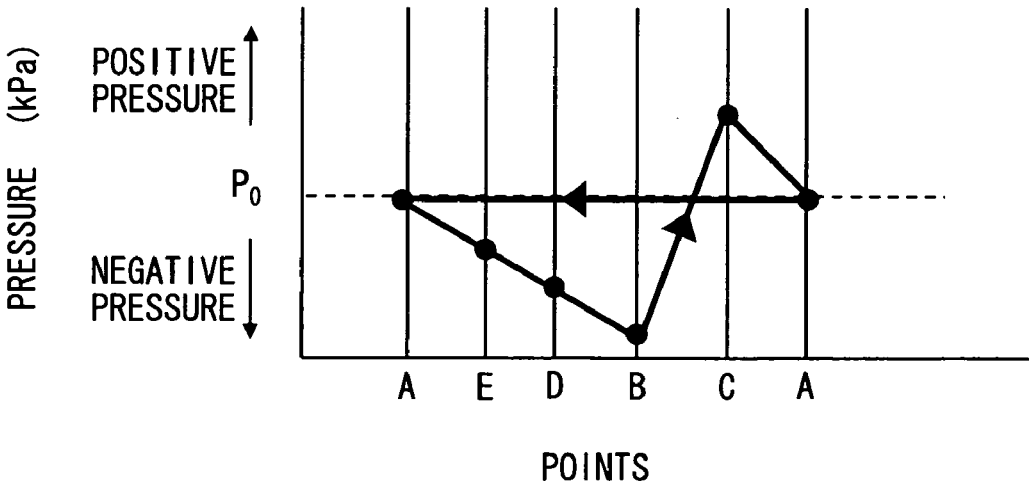
FIG. 21B is a graph showing a change in pressure of the brine circuit in the negative pressure mode shown in FIG. 20D.

Referring to FIGS. 21A and 21B, the change in pressure of the cooling apparatus 10 will be described. FIG. 21A shows the change in pressure when the cooling apparatus 10 is operated in the positive pressure mode, and FIG. 21B shows the change in pressure when the cooling apparatus 10 is operated in the negative pressure mode.

As shown in FIG. 21A, at the point A which is in the pressure-equalizing device 5, the pressure is equal to the atmospheric pressure since the third tank 5*h* is open to the atmosphere through the opening 5*e*. At the point B which is on the suction side of the pump 4, the pressure is slightly higher than that at the point A because of hydraulic head. At the point C which is on the discharge side of the pump 4, the pressure is higher than that at the point B because of the operation of the pump 4. The pressure is the highest at the point C in the brine circuit 1.

The pressure gradually reduces from the point C to the point D, and further toward the point E which is on a discharge side of the heat absorbing members 2 due to the passage resistance. The pressure further reduces from the point E toward the point A due to passage resistance. At the point A, the pressure is the same as the atmospheric pressure. By suctioning the brine in the pressure-equalizing device 5 by the pump 4, the brine is conducted in the brine circuit 1 in order of the points A, B, C, D, E, F, A. In this way, the brine passage of the heat exchanger group 20 is filled with the brine.

Then, as shown in FIG. 20D, the four-way valve 6 is switched to the negative pressure mode position to shift to the negative pressure mode. In this case, as shown in FIG. 21B, at the point A, the pressure is equal to the atmospheric pressure. The pressure gradually reduces from the point A to the point E, from the point E to the point D, from the point D to the point B due to the passage resistance. At the point C, the pressure increases because of the operation of the pump 4.

At the point C, the pressure is highest in the brine circuit 1. The pressure reduces from the point C toward the point A due to the passage resistance. At the point A, the pressure becomes the atmospheric pressure. In this way, the brine is circulated in the brine circuit 1 in the order of the points A, E, D, B, C, A. Accordingly, the pressure at the heat exchanger group 20 can be maintained lower than the atmospheric pressure.

Figure 20E:
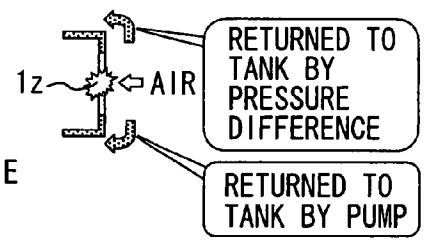
FIG. 20E is an explanatory view of a part XXE of a brine circuit of the cooling apparatus shown in FIG. 20D, when the brine circuit is broken, according to the fourteenth embodiment.

The cooling apparatus 10 is operated in the negative pressure mode in which the pressure at the heat exchanger group 20 is equal to or lower than the atmospheric pressure. Therefore, as shown in FIG. 20E, even if the brine passage is broken between the heat absorbing members 2 and the heat radiating member 3, the brine can be collected to the pressure-equalizing device 5. Therefore, it is less likely that the brine will leak from the brine circuit 1.

Fifteenth Embodiment

Figure 22:
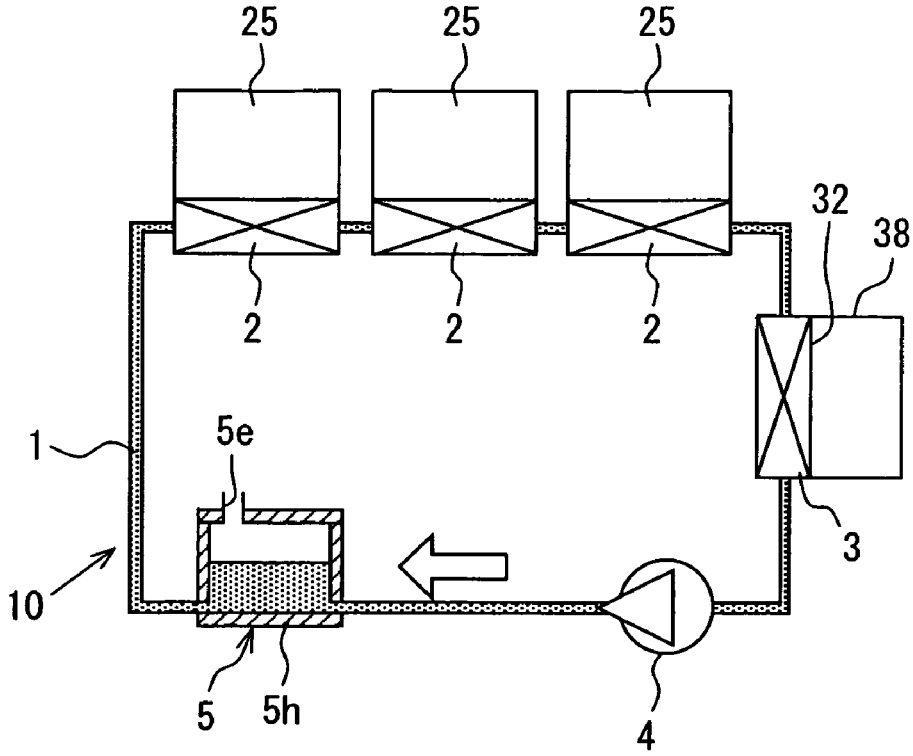
FIG. 22 is a schematic diagram of a cooling apparatus according to a fifteenth embodiment of the present invention.

Referring to FIG. 22, in the cooling apparatus 10 of the present embodiment, the heat of the heat radiating member 3 is released to a heating object 38, in place of the air by means of the fan 35.

The heating object 38 is arranged on an outer surface of the heat radiating member 3. For example, the heating object 38 is in closely contact with the outer surface of the housing 32 of the heat radiating member 3.

In this construction, the heat of the brine from the heat absorbing members 2 is conduced to the heating object 38 through the housing 32 while the brine passes through the brine passage 31 of the heat radiating member 3. Accordingly, the brine, which has received the heat from the electronic devices 25, is cooled by the heating object 38.

For example, the heating object 38 is constructed of a heat storage member. In this case, the heat generated from the electronic devices 25 is stored in the heating object 38, and is used for any purposes.

Other Embodiments

In the above embodiments, the cooling apparatus 10 has the three heat absorbing members 2 and the single heat radiating member 3. However, the number of the heat absorbing members 2 and the heat radiating member 3 is not limited to the above.

In the above embodiments, the cooling apparatus 10 is employed to cool the electronic devices 25, which are mounted on the vehicle, for example. However, the cooling apparatus 10 may be employed in any other purposes, such as for cooling heating elements and the like.

Additional advantages and modifications will readily occur to those skilled in the art. The invention in its broader term is therefore not limited to the specific details, representative apparatus, and illustrative examples shown and described.

What is claimed is:

1. A cooling apparatus using brine, comprising:

a brine circuit including:

a heat absorbing member that transmits heat generated from a cooling object to the brine to cool the cooling object;

a heat radiating member that radiates heat transmitted from the heat absorbing member to an atmosphere to cool the brine;

a pump that circulates the brine through the heat absorbing member and the heat radiating member; and a tank that stores the brine and equalizes pressure of the brine to atmospheric pressure so that the tank is constantly open to atmospheric pressure; wherein the brine circuit is configured by circularly connecting the heat absorbing member, the heat radiating member, the pump and the tank in this order;

a suction side of the pump is located lower than a liquid surface of the brine in the tank;

the brine circuit further includes a switching device disposed between the pump and the tank;

the switching device is configured to switch a flow direction of the brine by switching between a positive pressure mode position where the suction side of the pump is connected to the tank and a discharge side of the pump is connected to the heat radiating member and a negative pressure mode position where the suction side of the pump is connected to the heat radiating member and the discharge side of the pump is connected to the tank;

when the switching device is in the positive pressure mode position, pressure of the brine circulated to the heat absorbing member and the heat radiating member is controlled to a pressure higher than the atmospheric pressure;

when the switching device is in the negative pressure mode position, the pressure of the brine circulated to the heat absorbing member and the heat radiating member is controlled to a pressure lower than the atmospheric pressure;

the brine circuit further includes an air releasing device disposed between the tank and the heat absorbing member, and when the brine is filled in the brine circuit, the air releasing device is opened to an atmosphere so that the brine is fed to the pump due to hydraulic head of the brine stored in the tank.

* * * * *